US007150384B2

(12) United States Patent
Yasuike et al.

(10) Patent No.: US 7,150,384 B2
(45) Date of Patent: Dec. 19, 2006

(54) POWER-DRIVEN NAILING MACHINE

(75) Inventors: Minoru Yasuike, Tokyo (JP); Tatsushi Ogawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/223,774

(22) Filed: Sep. 12, 2005

(65) Prior Publication Data

US 2006/0081677 A1 Apr. 20, 2006

(30) Foreign Application Priority Data

Oct. 20, 2004 (JP) ..... P.2004-306059
May 24, 2005 (JP) ..... P.2005-150922

(51) Int. Cl.
*B25C 1/04* (2006.01)
*B27F 7/09* (2006.01)

(52) U.S. Cl. ..... 227/8

(58) Field of Classification Search ..... 227/8, 227/130, 120, 142
See application file for complete search history.

(56) References Cited

U.S. PATENT DOCUMENTS 4,821,937 A * 4/1989 Rafferty ..... 227/8
5,213,247 A * 5/1993 Gschwend et al. ..... 227/10
5,873,510 A * 2/1999 Hirai et al. ..... 227/130
5,996,874 A * 12/1999 Fukushima et al. ..... 227/8
6,003,751 A 12/1999 Ohmae
6,199,739 B1 * 3/2001 Mukoyama et al. ..... 227/8
6,883,696 B1 * 4/2005 Steinbrunner et al. ..... 227/8
6,974,062 B1 * 12/2005 Akiba ..... 227/8

FOREIGN PATENT DOCUMENTS

JP 10-309703 11/1998

* cited by examiner

*Primary Examiner*—Scott A. Smith
(74) *Attorney, Agent, or Firm*—Morgan, Lewis & Bockius LLP

(57) ABSTRACT

A contact member of a power-driven nailing machine is provided with a ring portion, a guide arm, and a guide portion. The ring portion is projected outwardly beyond a lower end of a nose portion and can keep a clearance from the lower end. The guide arm is extended upwardly from one end of the ring portion along a side surface of the nose portion. The guide portion is provided on an upper portion of the guide arm and can be slidably guided to the nose portion. The nose portion includes a projecting piece projected from the outer peripheral surface of the lower end toward an inner peripheral surface of the one end of the ring portion.

7 Claims, 13 Drawing Sheets

POWER-DRIVEN NAILING MACHINE

The present application claims foreign priority based on Japanese Patent Applications No. P.2004-306059 filed on Oct. 20, 2004, and No. P.2005-150922 filed on May 24, 2005, the contents of which are incorporated herein by reference.

BACKGROUND OF THE INVENTION

1. Field of the Invention

The present invention relates to a power-driven nailing machine driven by power such as compressed air, and especially to a power-driven nailing machine for nailing a roof material, such as an asphalt roofing with tar applied on a surface thereof, onto a base material of a roof.

2. Related Art

There is a case where a power-driven nailing machine driven by power such as compressed air is used for a nailing operation that a roof material such as an asphalt roofing formed in a sheet shape is nailed onto a base material of a roof. In the power-driven nailing machine, a striking mechanism such as a cylinder or a piston is accommodated a housing, and a nose portion, including an injection port for driving and guiding a nail, is mounted in a leading end of the housing. A driver for striking the nail is slidably accommodated in the injection port. The driver is driven within the injection port by the striking mechanism, thereby the nail supplied in the injection port is struck out of the injection port in the direction of the leading end of the injection port of the nose portion. As a result, a roof material such as an asphalt roofing set in the leading end of the nose portion is nailed on a base material of a roof. In the asphalt roofing, a tar is previously applied on the surface thereof for waterproofing.

When an operation of nailing the asphalt roofing with tar applied on the surface thereof is performed by the power-driven nailing machine under a condition that an air temperature is high or a sun blazes overhead and thus it is very hot, there is a possibility that the tar melted by heat can adhere to the leading end portion of the nose portion or to the leading end of the driver. In this case, when the driver returns again to the original top dead center after it is driven down to the bottom dead center by compressed air, the tar adhered to the nose portion can be pulled into an inside of the nose portion. Then, when the driver is driven repeatedly for a long time, the tar can adhere to and accumulate on an inner wall surface of the injection port of the nose portion to thereby increase the sliding resistance between the driver and nose portion. As a result, it becomes impossible for the driver and piston to return to their initial positions. That is, there can occur a poor operation phenomenon. In order to cope with the above phenomenon, JP-A-10-309703 discloses a nailing machine in which an outside diameter of the leading end portion of the driver is set smaller than the inside diameter of the injection port of the nose portion and the driver is structured such that it can be loosely guided through a driver guide hole and thus can be vibrated within the injection port in the striking or nailing operation. Thereby, in the nailing machine of JP-A-10-309703, the tar adhered to the inner wall surface of the injection port of the nose portion can be scraped and dropped out in the leading end direction of the injection port by the leading end portion of the driver vibrated within the injection port in the nailing operation.

By the way, there are power-driven nailing machines in which a contact member placed so as to project in the leading end direction of a nose portion is contact with a member to be nailed, and is thereby slidingly moved along the nose portion. In the power-driven nailing machine, an activation device is actuated by the slidingly moving contact member to thereby start the nailing operation. The nose portion formed in a cylindrical shape is loosely fitted with the inside of the contact member formed in a cylindrical shape to thereby slide and guide the contact member on the outer peripheral surface of the nose portion. When the nose portion is pressed against the member to be nailed, the contact member is contacted with the member to be nailed and is slided along the nose portion to thereby operate the activation device including a trigger lever or the like, so the nailing machine can be started.

In such nailing machine including the contact member which can be slided and operated along the nose portion, when nailing an asphalt roofing, the tar moves and accumulates between the outer peripheral surface of the nose portion and the inner peripheral surface of the contact member to thereby retard the sliding operation of the contact member. Thereby, it becomes impossible to start the nailing machine or it causes a malfunction of the nailing machine. In a related art, a groove having a semi-circular-arc-shaped section and extending in a vertical direction is formed between the contact member and nose portion, so that the tar adhered between the outer peripheral surface of the nose portion and the inner peripheral surface of the contact member can be removed along the groove. However, the tar cannot be removed completely by the related art. Therefore, in the related nailing machine, it is necessary to frequently carry out an operation in which the leading end portion of the nose portion and contact member are cleaned with gasoline or the like to thereby remove the tar adhered between them. Also, if the tar adhered to the nose portion is left overnight, the tar hardens and it is difficult to remove such hardened tar. Therefore, a trouble some cleaning operation must be executed after every end of daily nailing operation.

SUMMARY OF THE INVENTION

One or more embodiments of the present invention provide a tar adhesion preventing mechanism for a power-driven nailing machine in which tar moved into and accumulated between a nose portion and contact member can be removed automatically in linking with a nailing operation of the power-driven nailing machine to thereby prevent an occurrence of malfunction of the nailing machine by a failure of a sliding operation of a contact member.

In accordance with one or more embodiments of the present invention, a power-driven nailing machine is provided with: a nose portion; an injection port formed in the nose portion; a contact member slidably guided along the injection port and including a ring portion, a guide arm, and a guide portion, wherein a leading end of the nose portion is able to be inserted into the ring portion with a clearance, and the guide arm is extended upwardly from one end of the ring portion along the side surface of the nose portion, and the guide portion formed on an upper portion of the guide arm and slidably guided to the nose portion; and a projecting piece projected from an outer peripheral surface of the leading end of the nose portion toward an inner peripheral surface of the ring portion.

In accordance with one or more embodiments of the present invention, the projecting piece projects toward the inner peripheral surface of the ring portion at the one end where the guide arm is extended from the ring portion.

In accordance with one or more embodiments of the present invention, when the contact member is in a bottom dead center of the contact member, an upper end surface of the ring portion is positioned lower than a lower end surface of the leading end of the nose portion.

In accordance with one or more embodiments of the present invention, the power-driven nailing machine is further provided with: a guide rib formed on an outer peripheral surface of the nose portion. The guide portion of the contact member comprises a concave groove, and the concave groove surrounds the guide rib so as to be slidably fitted to the guide rib.

In accordance with one or more embodiments of the present invention, the power-driven nailing machine is further provided with: an activation device that activates a striking mechanism; and a contact arm connected to the activation device. An upper end of the guide arm is connected to a lower end of the contact arm, and the striking mechanism is activated in accordance with a sliding operation of the contact member so that a nail supplied into the injection port is struck and discharged out of the nose portion.

In accordance with one or more embodiments of the present invention, the power-driven nailing machine is further provided with: a threadedly engaging member for connecting a lower end portion of the contact arm with the upper end side of the guide arm; a cover member on the nose portion that covers substantially entire area of an operation range of the contact arm and an operation range of a connecting portion between the contact arm and the guide arm; and an opening formed in the cover member for allowing the head portion of the threadedly connecting member to face outside of the cover member.

In accordance with one or more embodiments of the present invention, the power-driven nailing machine is further provided with: at least two additional projection pieces, additionally formed on the outer periphery of the leading end side of the nose portion together with the projection piece. The two additional projection pieces are spaced apart from each other and are projected so as to be able to fit into an inside of the ring portion.

In accordance with one or more embodiments of the present invention, the contact member includes a ring portion not only projected outwardly beyond the leading end of the nose portion but also capable of keeping a clearance from the leading end side of the nose portion regardless of the sliding operation of the contact member to thereby allow insertion of the leading end side of the nose portion, a guide arm extended upwardly from one end of the ring portion along the side surface of the nose portion and having an upper end side connected to the contact arm, and a guide portion formed between the upper portion of the guide arm and the side surface of the nose portion and slidingly guided to the nose portion. Therefore, tar, that is adhered between the guide arm and the nose portion from a lower side and growing and accumulating to an upper side along an outer surface of the nose portion, can be discharged to an outer side of the ring portion. As a result, large amount of tar cannot be adhered between the nose portion and the ring portion of the contact member, and the increasing of the sliding resistance between the contact member and the nose portion by the tar can be prevented. Moreover, since a height of the ring portion is set small, washing solvent such as gasoline can easy permeate between the inside of the ring portion and outside of the nose portion. Therefore, the cleaning operation with the contact member left mounted can be executed easily.

Also, the nose portion includes a projecting piece provided on and projected from the outer peripheral surface of the leading end thereof toward the inner peripheral surface of the portion of the ring portion from which the guide arm is extended. Thanks to this, in such a portion as tar cannot be removed to the outside from the upper end of the ring portion due to the formation of the guide arm, in the sliding operation of the contact member, tar adhered between the contact member and nose portion can be scraped down in the leading end direction of the nose portion by the projecting piece. This can prevent the tar from growing and accumulating between the guide arm and nose portion and thus can prevent the sliding contact of the contact member from increasing.

Moreover, in accordance with one or more embodiments of the present invention, the nailing machine further includes a threadedly engaging member for connecting the lower end portion of the contact arm with the upper end side of the guide arm, a cover member mounted on the nose portion so as to be able to cover not only the substantially entire area of the operation range of the contact arm and but also the operation range of a connecting portion for connecting the lower end portion of the contact arm with the upper end side of the guide arm, and an opening formed in the outside of the cover member for allowing the head portion of the threadedly connecting member to be exposed to the outside of the cover member. Thanks to this, without removing the cover member from the nose portion, the bolt of the connecting portion can be loosed to thereby remove the contact member from the nose portion. Thereby, the cleaning operation of the contact member can be facilitated. Further, by mounting the cover member in such a manner that the leading end side of the contact member is exposed from the cover member, the cleaning operation with the contact member left mounted can be executed easily.

Moreover, in accordance with one or more embodiments of the present invention, on the outer periphery of the leading end side of the nose portion, together with the projecting piece, there are formed at least two projecting pieces in such a manner that they are spaced apart from each other and are projected so as to be able to fit into the inside of the ring portion of the leading end of the contact member. Thereby, the lower end portion of the guide arm is prevented from moving both in the back-and-forth direction but also in the right and left direction. Thanks to this, in a so-called shifting-type nailing operation in which the leading end of the contact member is shifted on the surface of the member to be nailed while the contact member is kept to be pushed toward the member to be nailed, even if moment is applied to the ring portion, the contact member can held by the projecting pieces and thus can be prevented from twisting. This can stabilize the sliding motion of the contact arm, which makes it possible to execute the nailing operation smoothly and positively.

Other aspects and advantages of the invention will be apparent from the following description and the appended claims.

DESCRIPTION OF THE PREFERRED EMBODIMENTS

Embodiments of the invention will be described with reference to the accompanying drawings.

Figure 1:
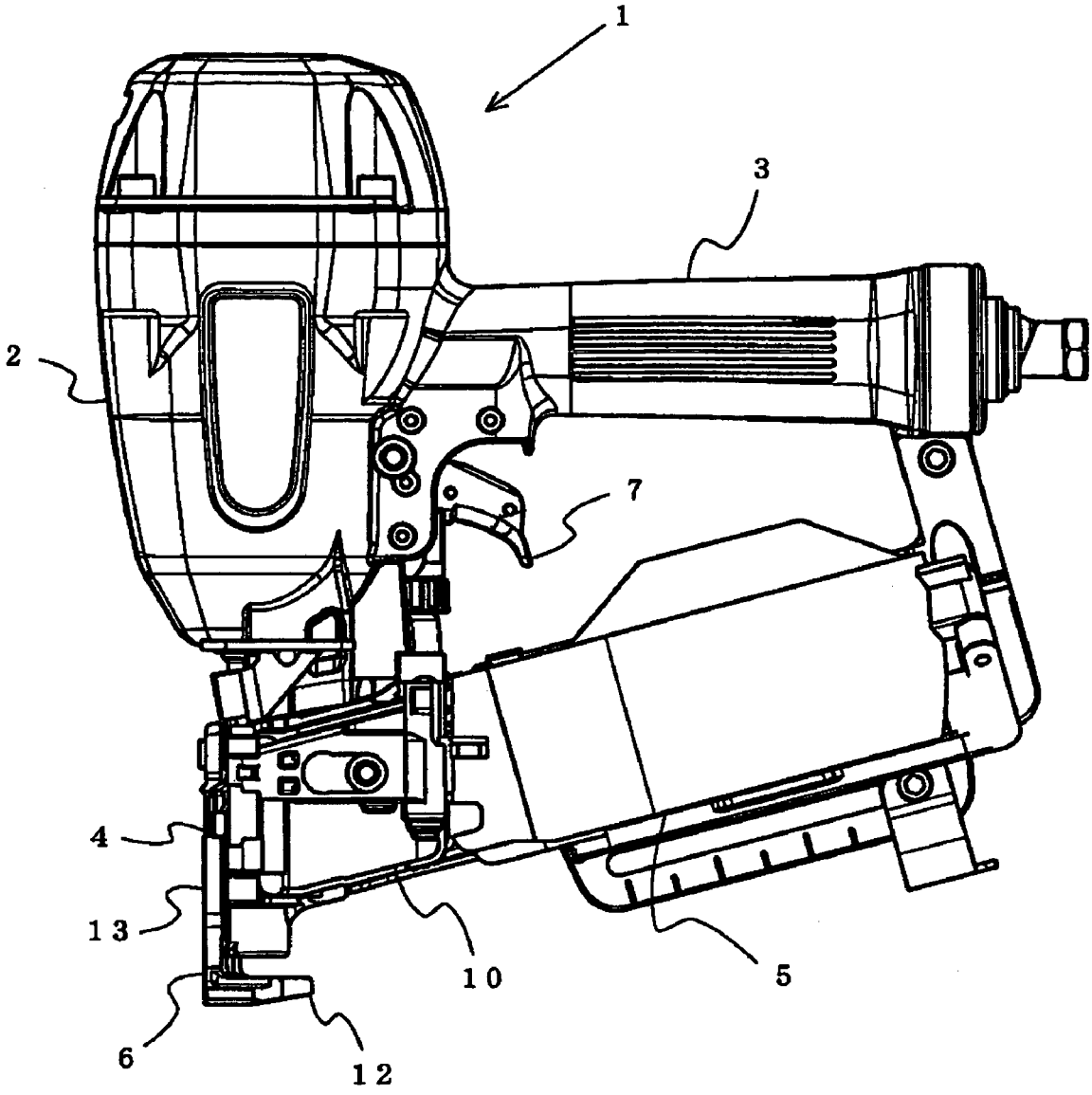
FIG. 1 is a side view of a power-driven nailing machine.
Figure 2:
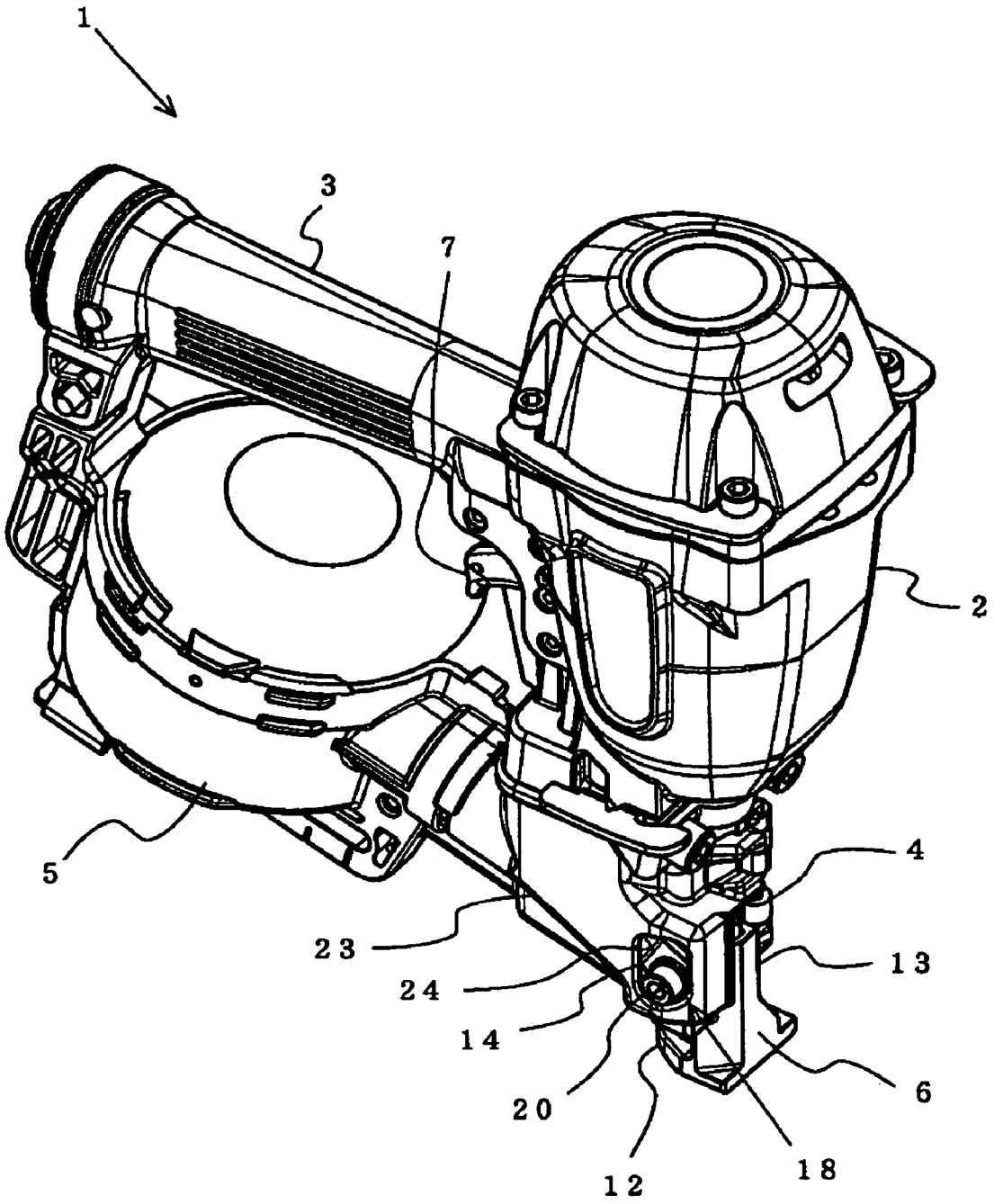
FIG. 2 is a perspective view of the power-driven nailing machine shown in FIG. 1.

FIGS. 1 and 2 show a power-driven nailing machine 1 in accordance with one or more embodiments of the present invention.

A housing 2 accommodates therein a striking mechanism composed of a piston/cylinder mechanism or the like. A grip portion 3 extends in a backward direction of the housing 2 and formed integrally with the housing. A nose portion 4 is mounted in a lower side of the housing 2 and includes an injection port for guiding the striking operation of a nail. A magazine 5 accommodates therein a large number of nails connected to each other. The magazine 5 is supported by the rear end of the grip portion 3 and the backward side surface of the nose portion 4. On the nose portion 4, there is mounted a contact member 6 which is normally projected in the direction of the leading end of the nose portion 4. The upper end portion of the contact member 6 is connected to an activation device formed in the base portion of the grip portion 3. By operating both this contact member 6 and a trigger lever 7 formed in the base portion of the grip portion 3, the striking mechanism can be driven through the activation device.

Figure 3:
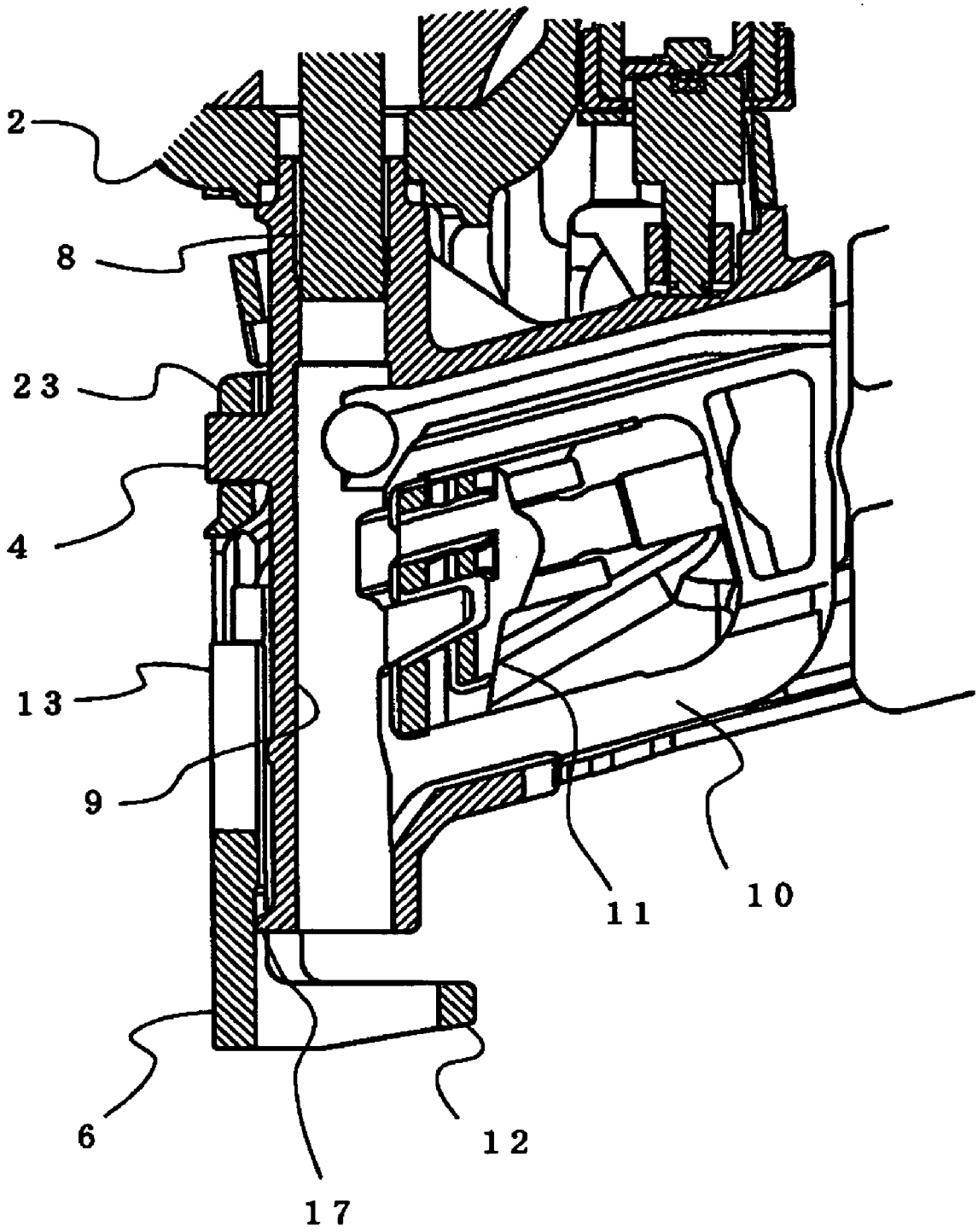
FIG. 3 is a longitudinal side view of a nose portion of the power-driven nailing machine shown in FIG. 1.

A driver 8 for striking the nail is mounted within the housing 2 so that it can be driven in an impact manner by the striking mechanism. As shown in FIG. 3, the driver 8 is accommodated and slidably guided in an injection port 9 formed in the nose portion 4. Between the magazine 5 and the injection port 9 of the nose portion 4, there is formed a nail supply guide 10 for feeding nails loaded in the magazine 5 into the injection port 9. The nails loaded in the magazine 5 is sequentially fed into the injection port 9 of the nose portion 4 by a nail supply mechanism 11 formed so as to operate along the nail supply guide 10. Thus, when the striking mechanism is driven, the nails supplied into the injection port 9 can be driven by the driver 8 so that the nails can be struck out in the direction of the leading end of the nose portion 4.

Figure 4:
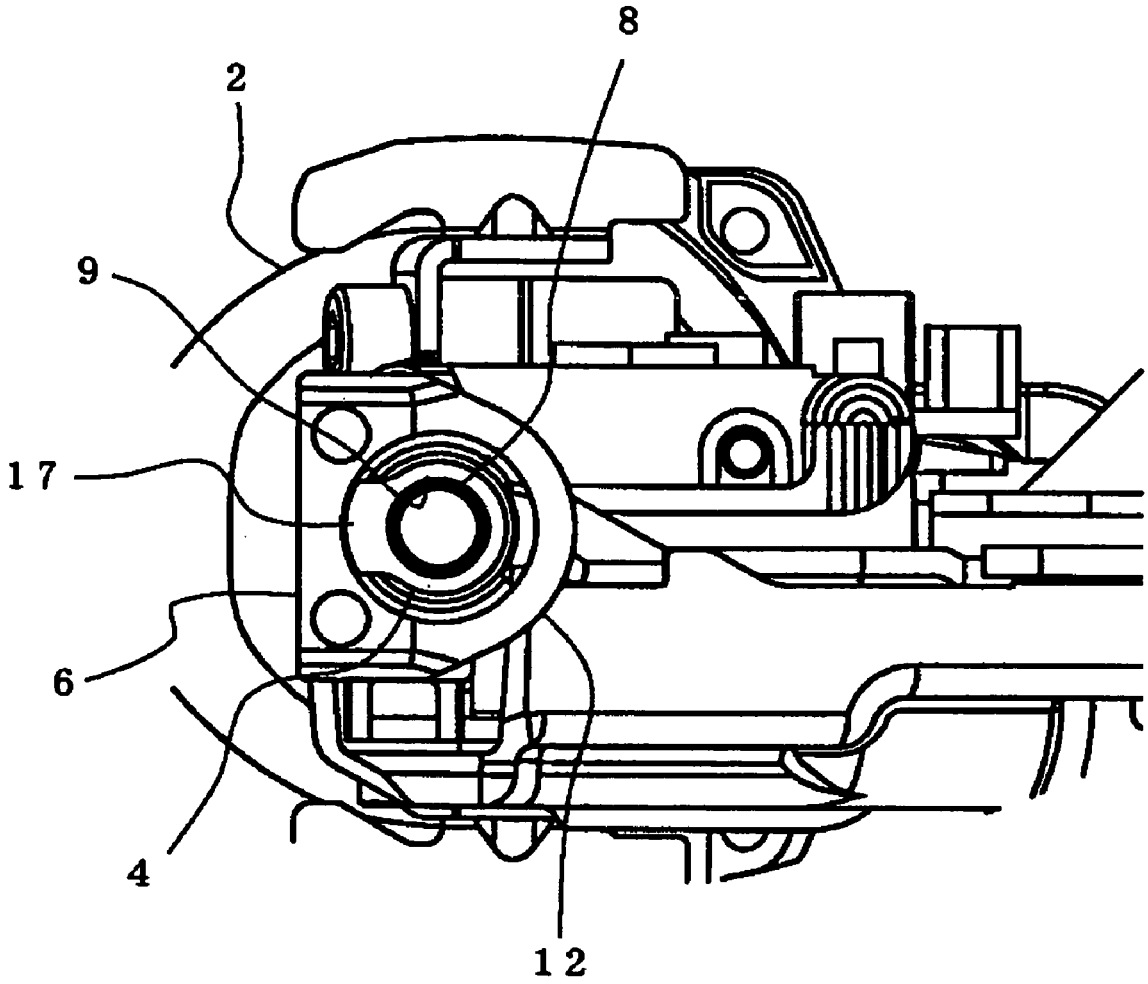
FIG. 4 is a bottom view of the nose portion of the power-driven nailing machine shown in FIG. 1.

As shown in FIGS. 3 and 4, the leading end portion of the nose portion 4, in which the injection port 9 is formed, is formed in a cylindrical shape. In a leading end portion of the contact member 6, which is positioned so as to project from the leading end of the nose portion 4 in the direction of the leading end thereof, there is formed a ring portion 12 including an opening formed in the central portion thereof so as to be able to accommodate the leading end of the nose portion 4 therein. Thus, the leading end portion of the nose portion 4 can be accommodated into the inside of the ring portion 12 and the ring portion 12 is slidable along the outer peripheral surface of the nose portion 4. An upper end surface of the ring portion 12 is positioned lower than a lower end surface of the leading end of the nose portion 4, when the contact member 6 positions in a bottom dead center of the contact member 6. A guide arm 13 is integrally formed on one part of the circumference of the ring portion 12 of the contact member 6 in such a manner that it extends linearly upwardly along the side surface of the nose portion 4. When the guide arm 13 is connected to the lower end of a contact arm 14 and the contact member 6 is slidingly operated along the nose portion 4, the upper end of the contact arm 14 actuates the activation device to thereby start the striking mechanism.

Figure 5:
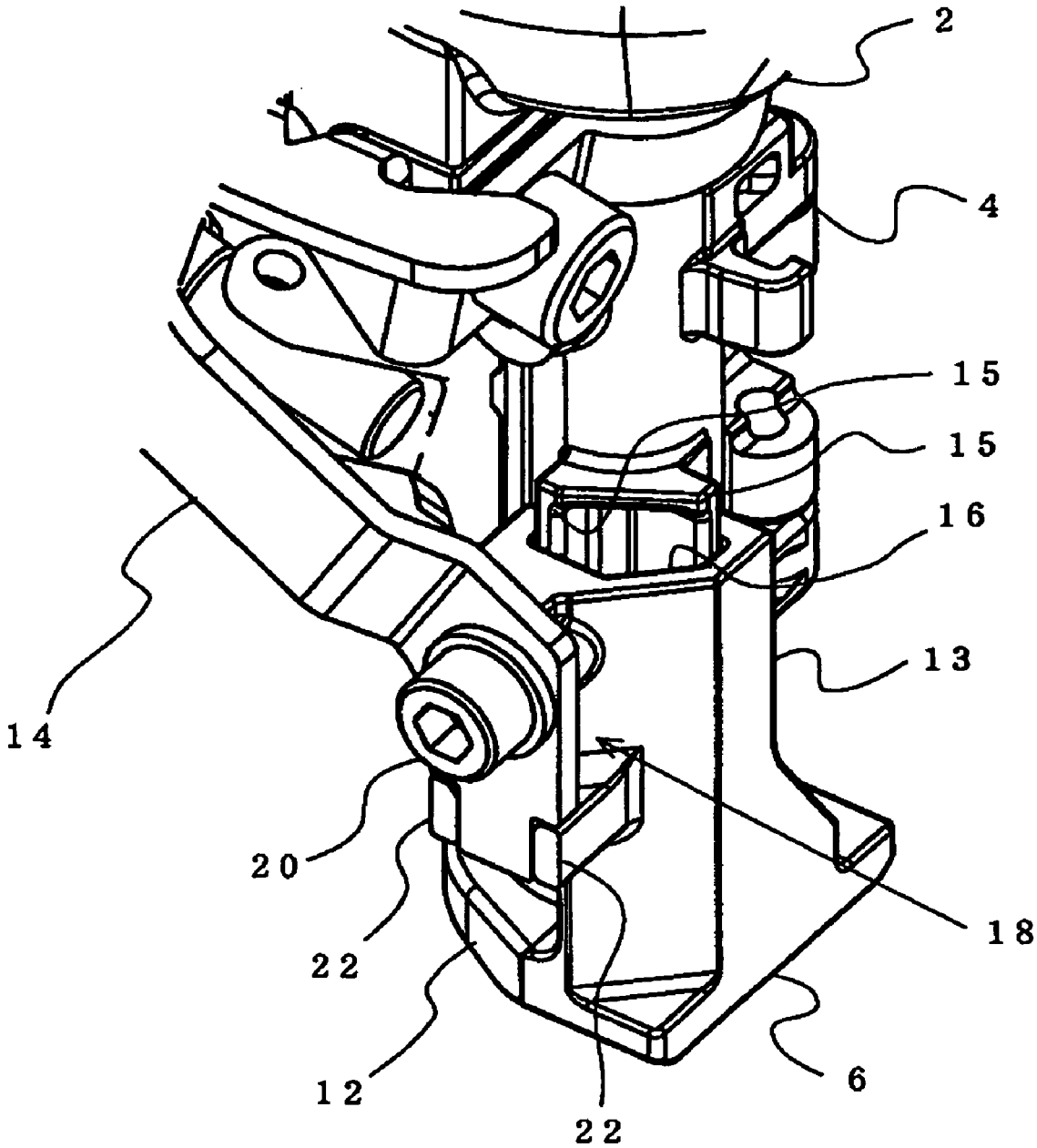
FIG. 5 is a perspective view of the power-driven nailing machine shown in FIG. 1 with a cover member removed therefrom.
Figure 6:
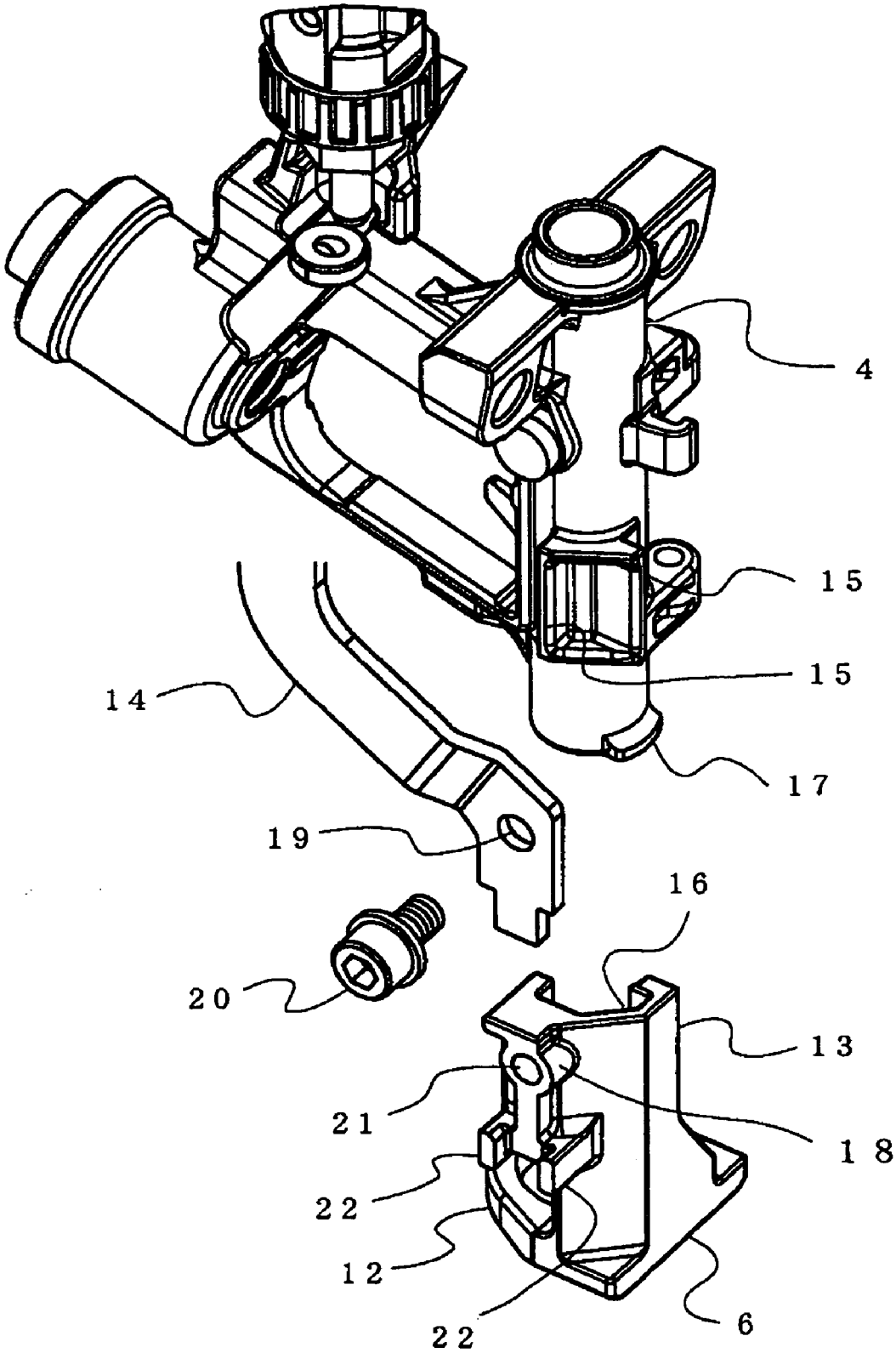
FIG. 6 is an exploded perspective view of parts arranged on the periphery of the nose portion of the power-driven nailing machine shown in FIG. 1.
Figure 7:
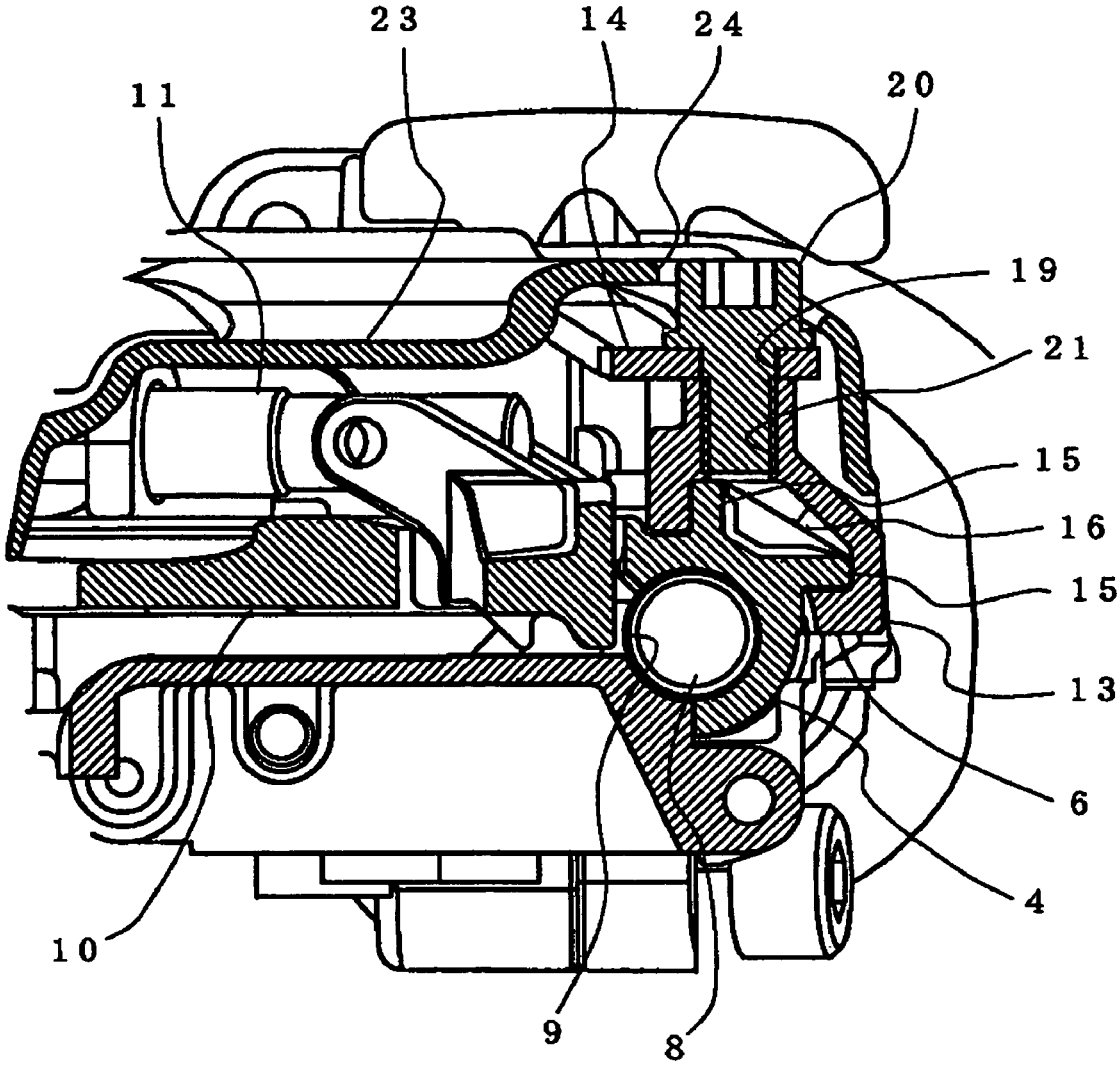
FIG. 7 is a transverse section view of the structure of a guide portion provided in the nose portion and guide arm of the power-driven nailing machine.

As shown in FIGS. 5, 6 and 7, between the guide arm 13 of the contact member 6 and the side surface of the nose portion 4, there is formed a guide portion which is used to slide and guide the contact member 6 along the nose portion 4. The guide portion is composed of a concave groove 16. Two ribs 15, 15 are formed on the outer peripheral surface of the nose portion 4 positioned upwardly apart from the leading end of the nose portion in such a manner that they extend in the axial direction of the injection port 9 and project from the outer peripheral surface of the nose portion 4 outwardly in the radial direction thereof so as to form a right angle between them. The concave groove 16 is formed in the upper portion of the guide arm 13 of the contact member 6 in such a manner that the concave groove accommodates the two ribs 15, 15. More specifically, the concave groove 16 holds the ribs 15, 15 therein from the outside of them, and the concave groove 16 surrounds the ribs 15, 15 so that the concave groove 15 is slidably fitted to the guide ribs 15, 15. By accommodating the guide ribs 15, 15 formed on the nose portion 4 into the concave groove 16 formed in the contact member 6, the contact member 6 can be slided and guided parallel to the injection hole 9 with respect to the nose portion 4. As described above, since a guide mechanism for sliding and guiding the contact member 6 to the nose portion 4 is composed of the two guide ribs 15, 15 formed in the upper portion of the nose portion 4 apart from the leading end thereof and the concave groove 16 of the contact member 6, there is eliminated the need to slide and guide the contact member 6 by the outer peripheral surface of the leading end of the nose portion 4. Thanks to this, not only a large clearance can be formed between the inner peripheral surface of the contact member 6 and the outer peripheral surface of the nose portion 4 but also the height dimension of the ring portion 12 of the contact member 6, which is formed in a ring-like manner, can be set small.

As shown in FIGS. 3, 4 and 6, on the outer peripheral surface of the leading end of the nose portion 4, there is formed a projecting piece 17 which is projected toward the inner peripheral surface of the ring portion 12. The projecting piece 17 is formed on the opposite side of the portion of the circumference on which the guide arm 13 of the ring portion 12 is formed integrally, while the leading end edge of the projecting piece 17 is formed so as to face the inner peripheral surface of the ring portion 12. When the contact member 6 is slided and operated with respect to the nose portion 4 in the direction of the leading end of the nose portion 4, the projecting piece 17 scrapes out tar adhered between the inner peripheral surface of the contact member 6 and the outer peripheral surface of the nose portion 4 in the direction of the leading end of the nose portion 4, thereby preventing the tar adhered between the inner peripheral surface of the contact member 6 and the outer peripheral surface of the nose portion 4 from accumulating upwardly along the clearance between the nose portion 4 and the guide arm 13 of the contact member 6. Also, if the clearance between the leading end of the projection piece 17 and the inner peripheral surface of the ring portion 12 is set as small as possible, the operation to scrape out the tar in the direction of the leading end of the nose portion 4 can be carried out more properly. In the present embodiment, the projecting piece 17 is formed on the outer peripheral surface of the leading end of the nose 4. However, the projection piece 17 is able to carry out the tar scraping operation, provided that it is formed in a portion existing between the above-mentioned guide portion and the outer peripheral surface of the leading end of the nose portion 4.

Further, as shown in FIGS. 5 and 6, on the outer surface of the guide arm 13 of the contact member 6, there is formed a connecting portion 18 which is used to connect the contact member 6 to the contact arm 14. The connecting portion 18, as shown in FIG. 6, is composed of a screw hole 21 and a pair of holding pieces 22. The screw hole 21 is used to secure the contact arm 14 to the connecting portion 18 by a bolt 20 (threadedly engaging member 20) through a mounting hole 19 formed in the leading end portion of the contact arm 14, while the holding pieces 22 are used to hold between them the leading end portion of the contact arm 14 from both sides so as to prevent the contact arm 14 from turning. That is, while moving the contact member 6 upwardly from the leading end direction of the nose portion 4 along the nose portion 4, the two guide ribs 15 formed in the nose portion 4 are engaged into the concave groove 16 of the guide arm 13 and, at the same time, the leading end portion of the contact arm 14 is engaged into the holding pieces 22 of the guide arm 13. In this condition, the contact arm 14 and contact member 6 are integrally tightened by the bolt 20 to thereby connect them to each other.

Further, as shown in FIGS. 2 and 7, in order to prevent the contact arm 14 from contacting to a member to be nailed by mistake and thus prevent a malfunction of the nailing machine 1, or in order to prevent an operator from touching the contact arm 14 while it is slidingly operating and thus prevent the operator from being injured, there is mounted a cover member 23 in such a manner that it covers the contact arm 14. The cover member 23 is mounted so as to cover one side surface of the nose portion 4 where the contact arm 14 is mounted; that is, the cover member 23 is mounted so as to be able to cover not only the substantially entire area of the sliding operation of the contact arm 14 but also the area of the sliding operation of the upper portion of the guide arm 13 in which the connecting portion 18 of the contact member 6 is positioned. And, in the portion of the cover member 23 which corresponds to the connecting portion 18 of the guide arm 13, there is formed an opening 24, while the end face of the bolt 20 on the head portion side thereof forming the connecting portion 18 can be exposed to the outside of the cover member 23 from the opening 24.

Thanks to this structure, without removing the cover member 23 from the nose portion 4, by loosening the bolt 20 of the connecting portion 18, the contact member 6 can be removed from the nose portion 4. Further, when the cover member 23 is mounted in such a manner that the portion of the ring portion 12 on the leading end side of the contact member 6 is exposed from the cover member 23, the cleaning operation of the contact member 6 can be performed easily while the contact member 6 is left mounted.

Figure 8:
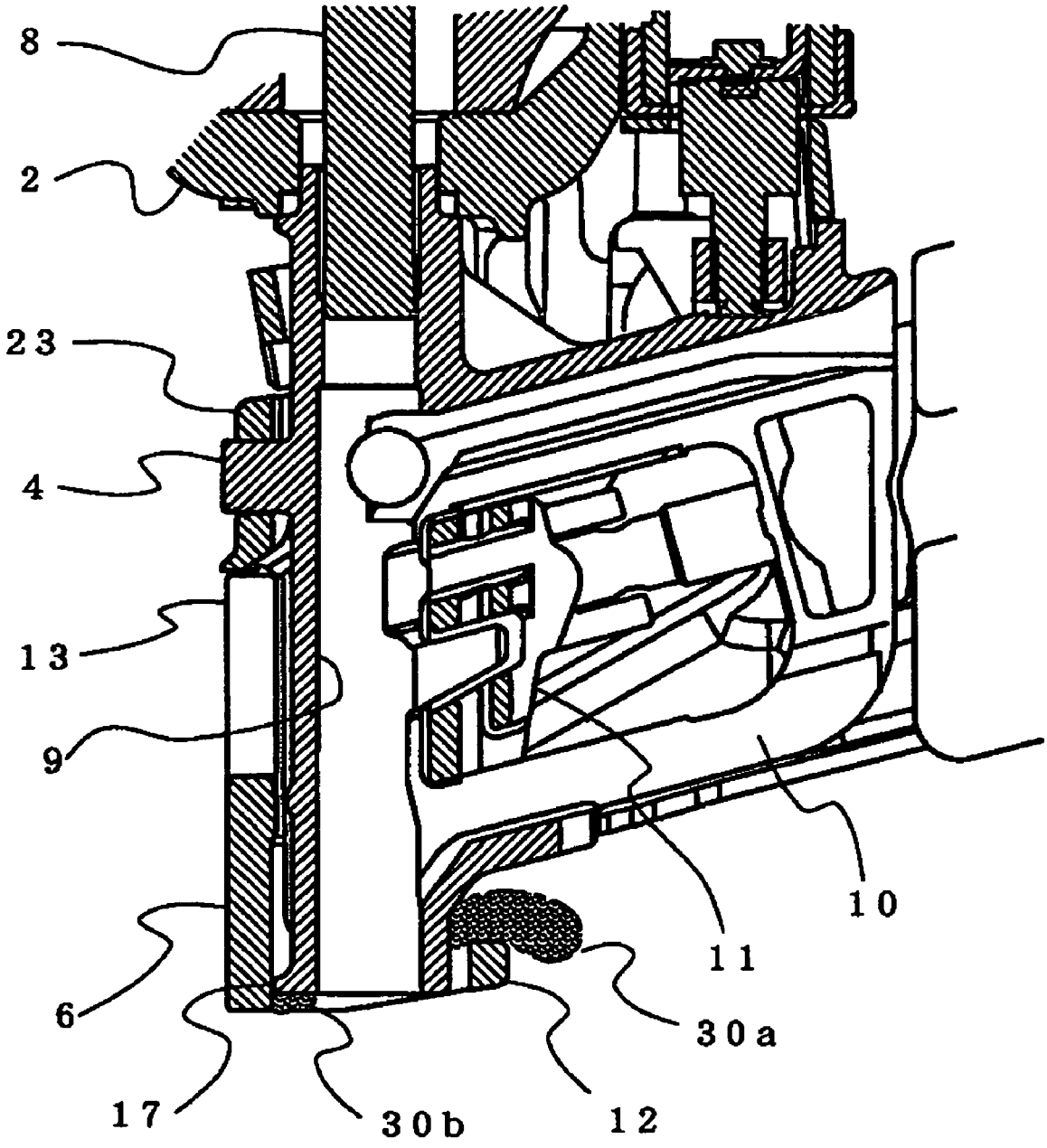
FIG. 8 is a longitudinal section view of the state of the power-driven nailing machine in which tar is removed through the operation of a contact member.

As shown in FIG. 8, description will be given here of tar 30*a* which has adhered to the contact member 6 and the leading end of the nose portion 4. When the power-driven nailing machine carries out its nailing operation in such a manner that the nose portion 4 is positioned onto the surface of the member to be nailed, the contact member 6 is slidingly moved upwardly with respect to the nose portion 4 and, with the sliding movement of the contact member 6, tar is moved upwardly along the outer peripheral surface of the nose portion 4. Since the ring portion 12 existing in the leading end of the contact member 6 is formed in a ring shape having a low height dimension, the tar 30*a*, which adheres to between the contact member 6 and nose portion 4 from the lower surface side thereof and accumulates there while growing upwardly along the outer peripheral surface of the nose portion 4, can be removed outside from the upper end of the ring portion 12 shown in FIG. 8. This can prevent the sliding resistance between the contact member 6 and nose portion 4 due to the tar from increasing. Also, because the ring portion 12 is projected further toward the leading end side than the leading end portion of the nose portion 4, with the contact member 6 left mounted on the nose portion 4, the inner peripheral surface of the ring portion 12 of the contact member 6 and the outer peripheral surface of the leading end of the nose portion 4 can be cleaned easily.

Also, since there is formed the guide arm 13 which extends upwardly from the one part of the ring portion 12 integrally therewith, there exists a portion where the tar cannot be removed outside from the upper end of the ring portion 12. However, in this portion, since there is provided the projecting piece 17 which is formed in the leading end of the nose portion 4 opposed to the guide arm 13 of the contact member 6 and projects toward the inner peripheral surface of the ring portion 12, tar 30*b* adhered between the contact member 6 and nose portion 4 can be scraped down by the projecting piece 17 during the sliding motion of the contact member 6. This can prevent the tar from growing and accumulating between the guide arm 13 and nose portion 4 and thus can prevent the sliding resistance of the contact member 6 from increasing.

On the outer periphery of the leading end side of the nose portion 4, besides the projecting piece 17, as shown below, there may also be provided more than one projecting piece in such a manner that they can fit into the inside of the ring portion of the leading end of the contact member 6. In each figure, the same components as in the embodiment shown in FIGS. 1 to 9 are denoted as like symbols.

Figure 9A:
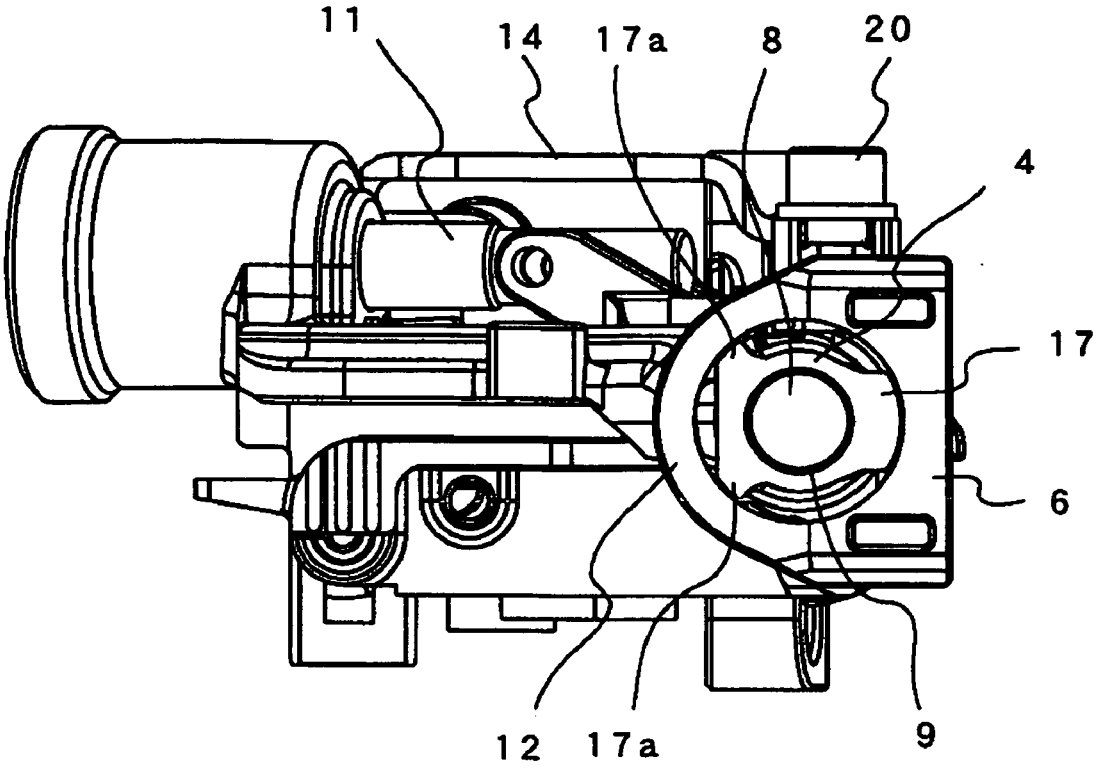
FIG. 9A is a bottom view of the nose portion in which two additional projection pieces are provided on the nose portion.
Figure 9B:
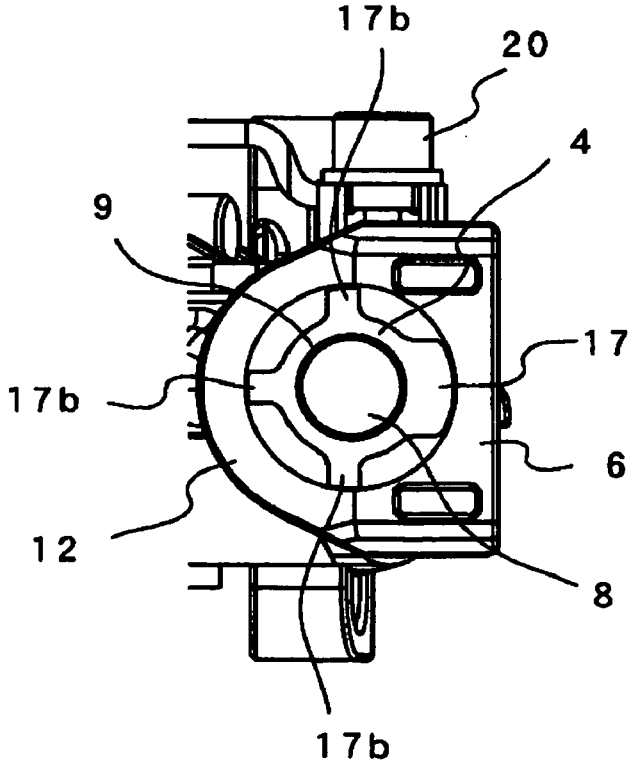
FIG. 9B is a bottom view of the nose portion in which three additional projection pieces are provided on the nose portion.
Figure 10:
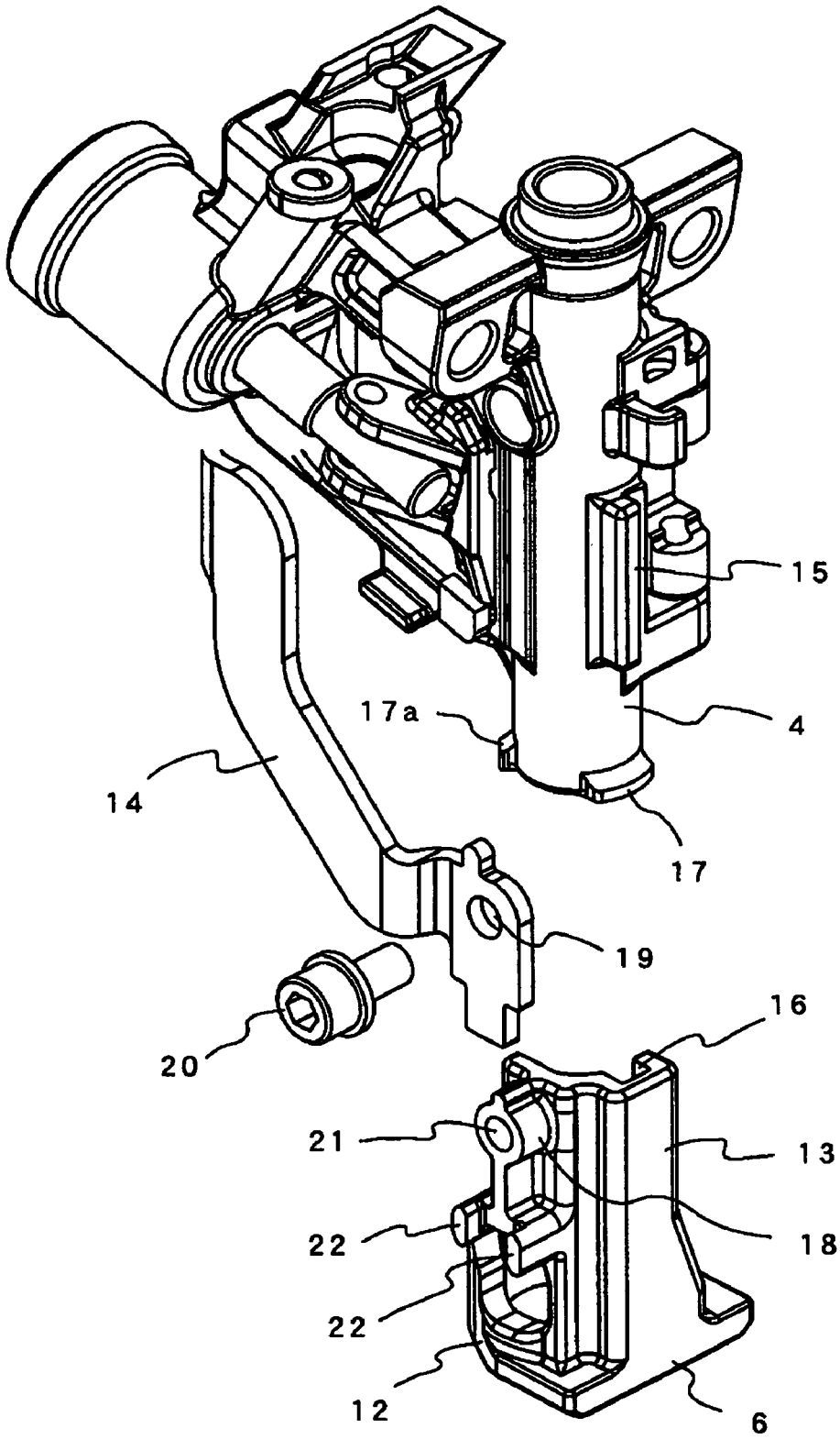
FIG. 10 is an exploded perspective view of the nose portion of the power-driven nailing machine.

For example, as shown in FIGS. 9A and 10, besides the projecting piece 17, two projecting pieces 17*a*, 17*a* (two additional projecting pieces 17*a*, 17*a*) are additionally provided; or, as shown in FIG. 9B, besides the projecting piece 17, three projecting pieces 17*b*, 17*b* and 17*b* (three additional projecting pieces 17*b*, 17*b* and 17*b*) are additionally provided.

According to the above structure of FIG. 9A, since not only the projecting piece 17 but also the two projecting pieces 17*a* are engaged with the inside of the ring portion 12 (of course, there are also still present small clearances), the ring portion 12 is supported at three points with respect to the nose portion 4. Similarly, in FIG. 9B, the ring portion 12 is supported at four points with respect to the nose portion 4.

Figure 11:
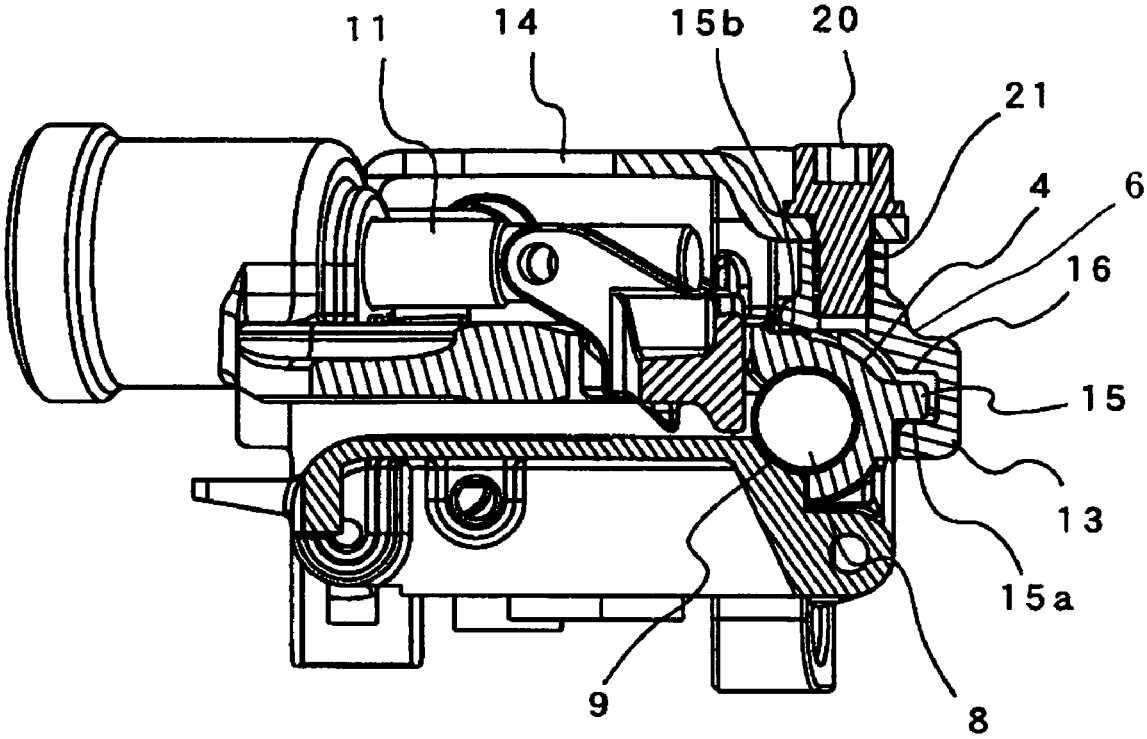
FIG. 11 is a transverse section view of the nose portion and contact member, showing how to guide the upper portion of the contact member.

Also, the upper portion of the guide arm 13 can be guided in such a manner that the concave groove 16 is engaged with the guide ribs 15 respectively formed on the upper portion of the front surface of the nose portion 4. At the then time, the contact member 6 is guided in such a manner that, as shown in FIG. 11, it is prevented from moving in the right and left directions while it is held by an engagement portion 15*a* between one side surface of the concave groove 16 and one outer surface of the guide rib 15 and an engagement portion 15*b* between one inner surface of the contact member 6 and one outer surface of the nose portion 4.

Figure 12:
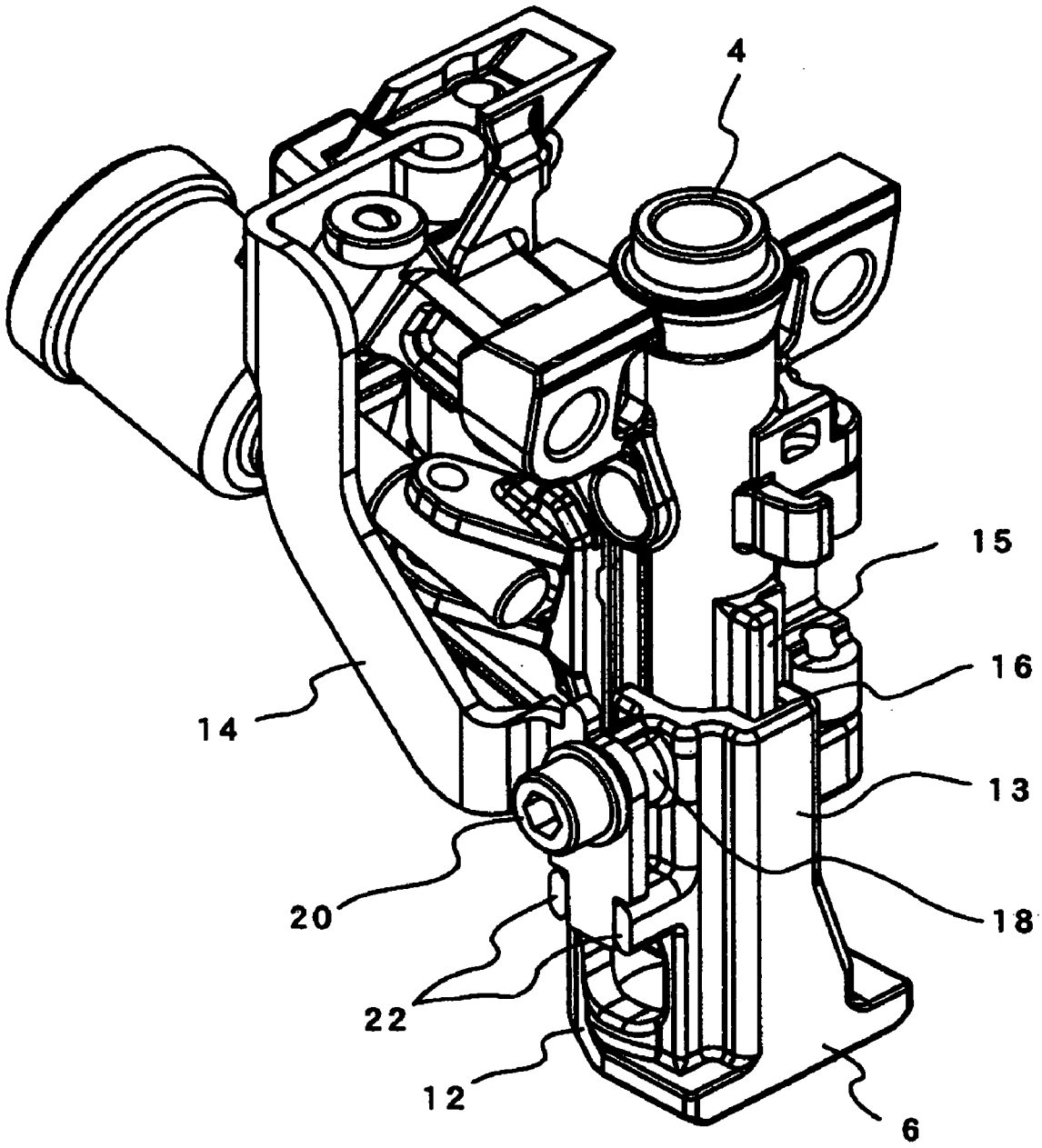
FIG. 12 is a perspective view of the nose portion and contact member when the assembly of the contact member is completed.

The contact member 6 is assembled in such a manner as shown in FIG. 12. Therefore, when the contact member 6 is slidingly moved in the direction of the leading end of the nose portion 4, the tar (not shown) adhered between the inner peripheral surface of the ring portion 12 of the contact member 6 and the outer peripheral surface of the nose portion 4 can be scraped out in the direction of the leading end of the nose portion 4 by the projecting piece 17. Thus, it is possible to prevent properly the tar from adhering to and accumulating in the above-mentioned portion and thus can prevent the contact member from malfunctioning. And, the maintenance of the nailing machine is easy. Also, since the projecting piece 17 is formed in the lower end of the nose portion 4, the tar is prevented from moving upwardly of the projecting piece 17; and, because there are formed clearances between the projecting piece 17 and two projecting pieces 17*a*, even if the tar adheres to the ring portion 12 and the amount of tar adhesion increases, the tar can move upwardly through the clearances, go beyond the ring portion 12 and drop down, which raises no problem.

Also, since the lower end portion of the guide arm 13 is prevented from moving not only in the back-and-forth direction but also in the right-and-left direction, even when the leading end of the contact arm 14 is moved while shifting the surface of the member to be nailed (that is, in a so called shifting-type nailing operation) and thus moment is applied to the ring portion 12, the contact member 6 is held by the projecting pieces 17, 17*a* (17*b*) and is thereby prevented from dislocating, which can stabilize the sliding motion of the contact arm 14 and thus can carry out the nailing operation of the nailing machine smoothly and positively.

Further, since the upper portion of the contact member 6 is guided to the nose portion 4 by the engagement portion 15*a*, 15*b* and the lower portion thereof is guided by the projecting pieces 17, 17*a* (17*b*), the contact arm 14 can be always slided smoothly.

Figure 13:
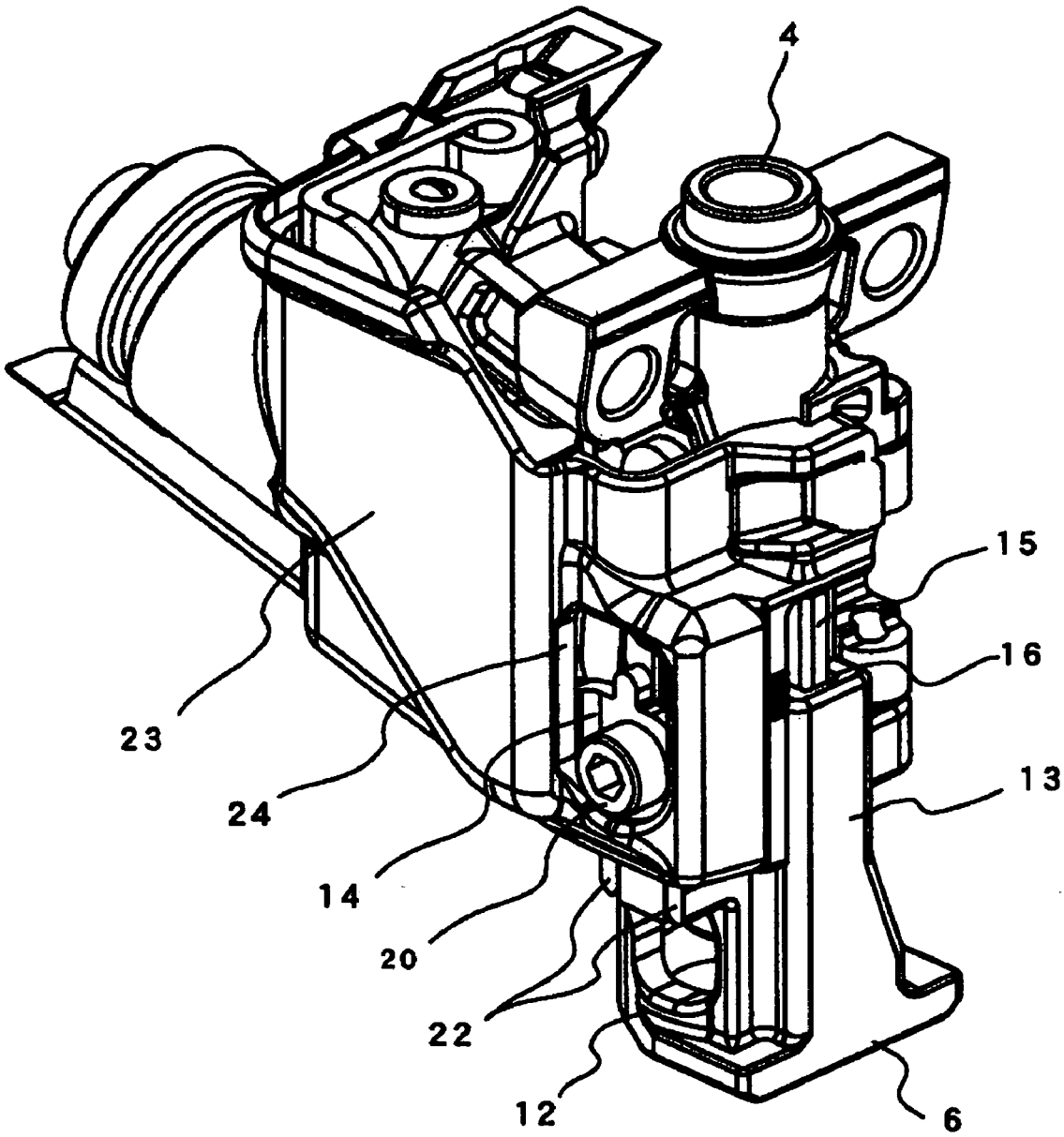
FIG. 13 is a perspective view of the nose portion and contact member, showing a state in which a cover member has been mounted.

And, as shown in FIG. 13, a cover member 23 is mounted on the outside of the contact arm 14. In this figure, in the portion of the cover member 23 that corresponds to the connecting portion 18 of the guide arm 13 (see FIG. 10), there is formed an opening 24 so that the end face of the head side of the bolt 20 forming the connecting portion 18 can be exposed from the opening 24 to the outside of the cover member 23. Therefore, similarly to the above-mentioned embodiment, without removing the cover member 23, the contact member 6 can be removed from the nose portion 4 and, with the contact member 6 left mounted, the cleaning operation can be executed easily.

Of course, the number of the projecting pieces is not limited to the above-mentioned embodiment. And, the projecting pieces may also be formed on the periphery of the lower end of the nose portion in the form of gears.

In the present embodiment, description has been given only of a power-driven nailing machine which uses compressed air as its power driving source. However, of course, the invention can also apply to a nailing machine in which a power driving source is not limited to compressed air but a power driving source of a gas combustion type or an electric motor can be used as its power driving source.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A power-driven nailing machine comprising:

a nose portion;

an injection port formed in the nose portion;

a contact member slidably guided along the injection port and including a ring portion, a guide arm, and a guide portion, wherein a leading end of the nose portion is able to be inserted into the ring portion with a clearance, and the guide arm is extended upwardly from one end of the ring portion along the side surface of the nose portion, and the guide portion formed on an upper portion of the guide arm and slidably guided to the nose portion; and a projecting piece projected from an outer peripheral surface of the leading end of the nose portion toward an inner peripheral surface of the ring portion.

2. The power-driven nailing machine according to claim 1, wherein the projecting piece projects toward the inner peripheral surface of the ring portion at the one end where the guide arm is extended from the ring portion.

3. The power-driven nailing machine according to claim 1, when the contact member is in a bottom dead center of the contact member, an upper end surface of the ring portion is positioned lower than a lower end surface of the leading end of the nose portion.

4. The power-driven nailing machine according to claim 1, further comprising:

a guide rib formed on an outer peripheral surface of the nose portion, wherein the guide portion of the contact member comprises a concave groove, and the concave groove surrounds the guide rib so as to be slidably fitted to the guide rib.

5. The power-driven nailing machine according to claim 1, further comprising:

an activation device that activates a striking mechanism; and a contact arm connected to the activation device, wherein an upper end of the guide arm is connected to a lower end of the contact arm, and the striking mechanism is activated in accordance with a sliding operation of the contact member so that a nail supplied into the injection port is struck and discharged out of the nose portion.

6. The power-driven nailing machine according to claim 5, further comprising:

a threadedly engaging member for connecting a lower end portion of the contact arm with the upper end side of the guide arm;

a cover member on the nose portion that covers substantially entire area of an operation range of the contact arm and an operation range of a connecting portion between the contact arm and the guide arm; and an opening formed in the cover member for allowing the head portion of the threadedly connecting member to face outside of the cover member.

7. The power-driven nailing machine according to claim 1, further comprising:

at least two additional projection pieces, additionally formed on the outer periphery of the leading end side of the nose portion together with the projection piece, wherein the two additional projection pieces are spaced apart from each other and are projected so as to be able to fit into an inside of the ring portion.

* * * * *